United States Patent [19]

Tateishi et al.

[11] Patent Number: 4,526,151

[45] Date of Patent: Jul. 2, 1985

[54] FUEL INJECTION DEVICE

[75] Inventors: Mataji Tateishi; Etsuo Kunimoto; Tatsuo Takaishi, all of Nagasaki, Japan

[73] Assignee: Mitsubishi Jukogyo Kabushiki Kaisha, Tokyo, Japan

[21] Appl. No.: 470,492

[22] Filed: Feb. 28, 1983

[30] Foreign Application Priority Data

| | | | |
|---|---|---|---|
| Mar. 12, 1982 | [JP] | Japan | 57-38178 |
| Oct. 14, 1982 | [JP] | Japan | 57-15438[U] |
| Oct. 14, 1982 | [JP] | Japan | 57-15439[U] |
| Oct. 22, 1982 | [JP] | Japan | 57-158919[U] |
| Oct. 22, 1982 | [JP] | Japan | 57-158920[U] |

[51] Int. Cl.[3] ..... F02M 55/02

[52] U.S. Cl. ..... 123/468; 138/44

[58] Field of Search ..... 123/468–471; 239/589; 138/44, 40

[56] References Cited

U.S. PATENT DOCUMENTS

| | | | |
|---|---|---|---|
| 4,285,534 | 8/1981 | Katayama et al. | 138/44 |
| 4,363,446 | 12/1982 | Jaggle et al. | 123/468 |

FOREIGN PATENT DOCUMENTS

| | | | |
|---|---|---|---|
| 494739 | 3/1930 | Fed. Rep. of Germany | 138/44 |
| 1050597 | 1/1954 | France . | |
| 1359315 | 3/1964 | France . | |
| 1487778 | 10/1977 | United Kingdom . | |
| 2026602 | 7/1978 | United Kingdom . | |
| 478120 | 2/1976 | U.S.S.R. | 123/468 |
| 712524 | 1/1980 | U.S.S.R. | 123/468 |

*Primary Examiner*—Magdalen Y. C. Moy

*Attorney, Agent, or Firm*—Wenderoth, Lind & Ponack

[57] ABSTRACT

A fuel injection device in which a fuel injection pump is connected through a fuel injection pipe to a fuel injection nozzle. The inner diameter of the fuel injection pipe is reduced from the side of the fuel injection pump towards the side of the fuel injection nozzle in either a stepwise manner or continuously.

6 Claims, 31 Drawing Figures

FUEL INJECTION DEVICE

BACKGROUND OF THE INVENTION

The present invention relates to a fuel injection device for an internal combustion engine.

A construction of a fuel injection system in the prior art is illustrated in FIG. 1. In this figure, reference numeral 10 designates a fuel injection pump main body, numeral 20 designates a plunger, numeral 30 designates a delivery valve, numeral 31 designates a delivery valve spring, numeral 32 designates a delivery valve chamber, numeral 40 designates a fuel injection pipe, numeral 50 designates a fuel injection valve main body and numeral 51 designates a nozzle tip portion.

Now description will be made of the operation of the above-described system in the prior art. The plunger 20 is driven by a cam (not shown), then compressed fuel raises the delivery valve 30 against the spring 31 and enters the delivery valve chamber 32, further it generates a pressure wave within the injection pipe 40, this pressure wave enters the fuel injection valve 50 to push up an automatic valve (not shown) provided within the valve, and the fuel is injected into an engine combustion chamber through the nozzle injection hole at the nozzle tip end portion 51.

The main construction of this fuel injection system is diagrammatically shown in FIG. 2, and the injection system in the prior art generally has a fuel injection pipe whose cross-sectional area (or inner diameter) is uniform over the entire length.

The injection system in the prior art has an injection hole choke at the tip end of the fuel injection pipe having a uniform cross-sectional area. As a result, the pressure wave propagated through the fuel injection pipe rises in pressure at the injection hole section and thus provides injection. However, at that time, a part of the energy of the pressure wave is reflected and returns to the side of the fuel injection pump where it is again reflected, resulting in secondary injection. Representing the cross-sectional area of the injection pipe by $A_p$ and the cross-sectional area of the nozzle by $A_N$ in FIG. 2, the magnitude of the reflection wave becomes large as the ratio $A_p/A_N$ is increased, and secondary injection is liable to occur. In order to prevent this phenomenon, a large amount of suction back function is necessitated at the delivery valve section on the pump side, but if the amount of suction back is too large, cavitation would be generated. For the purpose of preventing this shortcoming, if the ratio $A_p/A_N$ is chosen small and $A_p$ is reduced, then generally cut-off at the end of injection can be improved, but the pressure on the pump side rises and hence a reduction is liable to occur in the durability of the cam and the pump. It is to be noted that in FIG. 2 reference character $A_{PL}$ represents a cross-sectional area of a plunger, reference character $L_p$ represents a length of the injection pipe and reference character $P_o$ represents an open valve pressure of the nozzle.

As described above, in the fuel injection system in the prior art having a fuel injection pipe with a uniform cross-sectional area, secondary injection or cavitation is liable to occur, and in the case of a thin fuel injection pipe, the pressure loss is increased and hence the pressure on the pump side is increased, while in the case of a thick fuel injection pipe, the pressure falls slowly and hence cut-off of the injection is not good.

BRIEF SUMMARY OF THE INVENTION

It is therefore one object of the present invention to provide a fuel injection device in a fuel injection system for a diesel engine, in which the pressure on the side of the fuel injection pump is lowered, while the pressure on the side of the fuel injection nozzle is raised, to inject high pressure fuel and to improve cut-off of injection, and thereby improvements in a performance of an internal combustion engine can be realized.

According to one feature of the present invention, there is provided a fuel injection device including a fuel injection pump, a fuel injection nozzle and a fuel injection pipe for connecting the fuel injection pump to the fuel injection nozzle, in which the cross-sectional area (inner diameter) of the fuel injection pipe is reduced either continuously or in a stepwise manner from the side of the fuel injection pipe towards the fuel injection nozzle.

The present invention is applicable to a large-sized or medium-sized diesel engine, a small-sized high speed diesel engine, a fuel injection type laminar combustion engine and a dual-fuel engine.

BRIEF DESCRIPTION OF THE DRAWINGS

The above-mentioned and other features and objects of the present invention will become more apparent by reference to the following description of preferred embodiments of the invention taken in conjunction with the accompanying drawings, wherein.

DETAILED DESCRIPTION OF THE PREFERRED EMBODIMENTS

Figure 3:
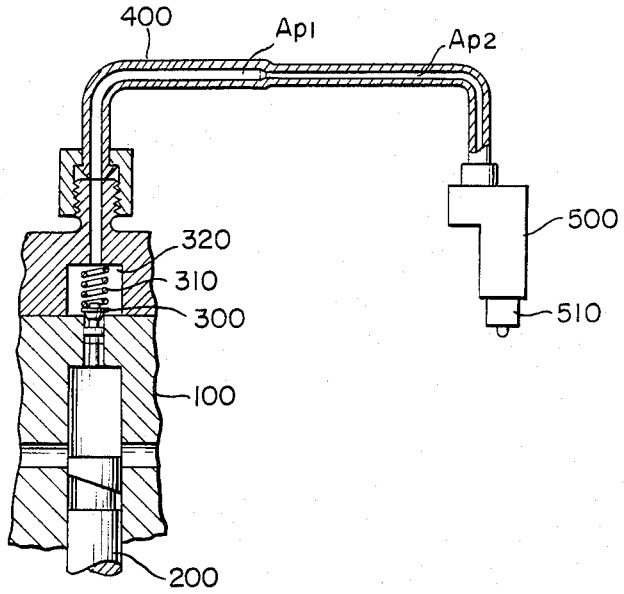
FIG. 3 is a schematic view showing a fuel injection system provided with a two-step fuel injection pipe according to a first preferred embodiment of the present invention.

Referring now to FIG. 3, a fuel injection system provided with a two-step fuel injection pipe according to a first preferred embodiment of the present invention, is illustrated. The basic construction of the fuel injection pump section and the fuel injection valve section is similar to that in the prior art, in which reference numeral 100 designates a fuel injection pump main body, numeral 200 designates a plunger, numeral 300 designates a delivery valve, numeral 310 designates a delivery valve spring, numeral 320 designates a delivery valve chamber, numeral 400 designates a fuel injection pipe, numeral 500 designates a fuel injection valve, and numeral 510 designates a nozzle tip section. In the above-mentioned construction it is a characteristic feature of the present invention that the fuel injection pipe 400 has its cross-sectional area (inner diameter) reduced midway along its length $A_{p1}$ to $A_{p2}$ ($A_{p1} > A_{p2}$).

Diagrammatical illustration of the basic construction as described above is given in FIG. 4, in which the total length of the portion corresponding to the injection pipe 400 in FIG. 3 is represented by $L_p$, the length of the portion having the cross-sectional area $A_{p1}$ is represented by $L_{p1}$, the length of the portion having the cross-sectional area $A_{p2}$ is represented by $L_{p2}$, the nozzle cross-sectional area is represented by $A_N$, and according to the present invention, the construction fulfils the following relation.

$$A_{p1} > A_{p2} > A_N$$

In this figure, reference character $A_{PL}$ represents a cross-sectional area of the plunger, and reference character $P_o$ represents an open valve pressure.

Now description will be made on the operation of the above-described construction.

Figure 4:
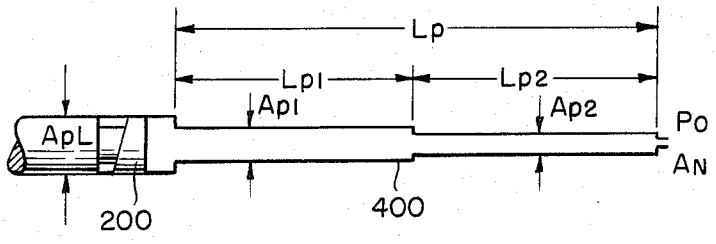
FIG. 4 is a diagrammatic view of the fuel injection system in FIG. 3, FIG. 5(*a*) is a diagram showing a pressure rising characteristic in the beginning of injection in the case of the two-step injection pipe shown in FIG. 3, FIG. 5(*b*) is a diagram showing a pressure falling characteristic at the end of injection in the same case.

The basic operation of the fuel injection system is similar to that of the prior art system, that is, the plunger 200 is driven by a fuel cam (not shown), the fuel compressed by the plunger 200 pushes up the delivery valve 300 against the delivery valve spring 310 to flow into the delivery valve chamber 320 and further flow into the injection pipe, and the energy of fuel injection is propagated as a pressure wave towards the fuel injection valve 500. Furthermore, the fuel in the neighborhood of the nozzle tip section is brought to a high pressure by the pressure wave and pushes up an automatic valve (not shown). Then this fuel is injected into an engine combustion chamber (not shown) through an injection hole. In this case, what is different from the injection system in the prior art is that the injection pipe is reduced in cross-sectional area from $A_{p1}$ to $A_{p2}$ at a midway point of length $L_p$ at the downstream end of length $L_{p1}$ as shown in FIG. 4. Consequently, the pressure wave generated at the inlet of the fuel injection pipe has a part of its energy reflected at this midway point because the cross-sectional area is reduced from $A_{p1}$ to $A_{p2}$, and returned to the side of the pump, so that rise of a pressure on the pump side becomes fast. On the other hand, the pressure wave entered the smaller diameter portion of the injection pipe having a cross-sectional area $A_{p2}$ is propagated to the side of the nozzle. However, at this portion, since the nozzle choke ratio is reduced in the manner of $A_{p1}/A_N > A_{p2}/A_N$ as compared to the large diameter portion of the injection pipe having a cross-sectional area of $A_{p1}$, the energy of the reflected pessure wave is reduced and thus cut-off of injection can be improved, and also hardly any secondary injection occurs. The results of a calculation of this condition by a characteristic curve method which is a one-dimensional unsteady flow analyzing process, are shown in FIGS. 5(*a*) and 5(*b*).

Figure 1:
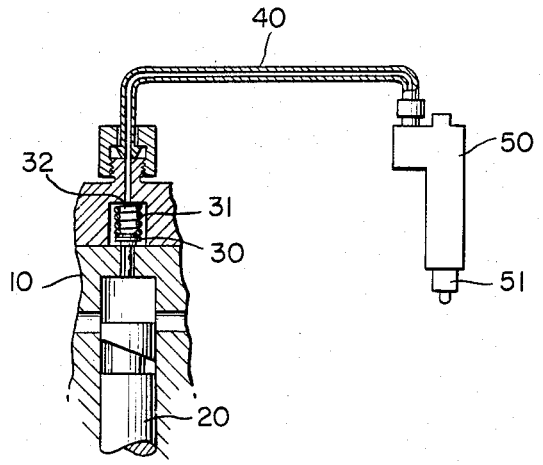
FIG. 1. (PRIOR ART)
FIG. 1 is a schematic view showing a fuel injection system in the prior art.
Figure 2:
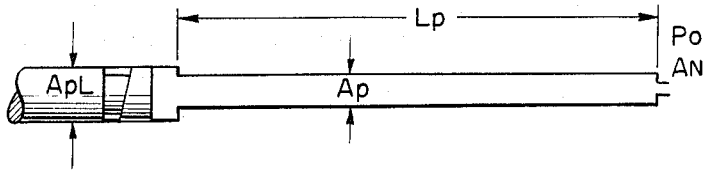
FIG. 2. (PRIOR ART)
FIG. 2 is a diagrammatic view of the fuel injection system in FIG. 1.
Figure 5A:
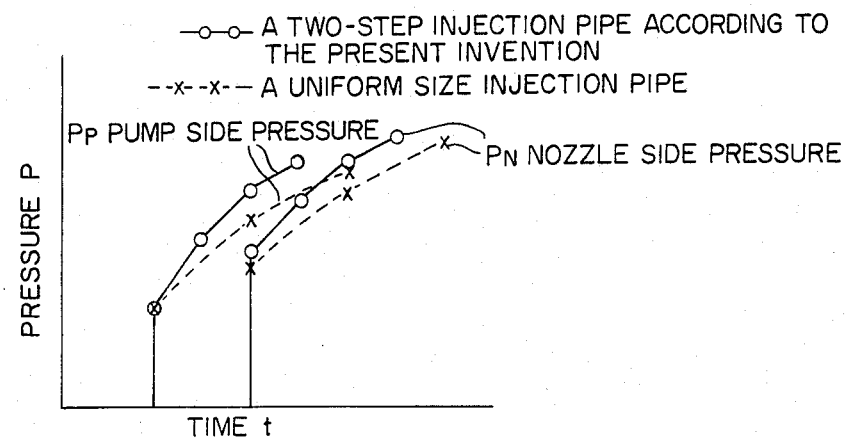
Figure 5B:
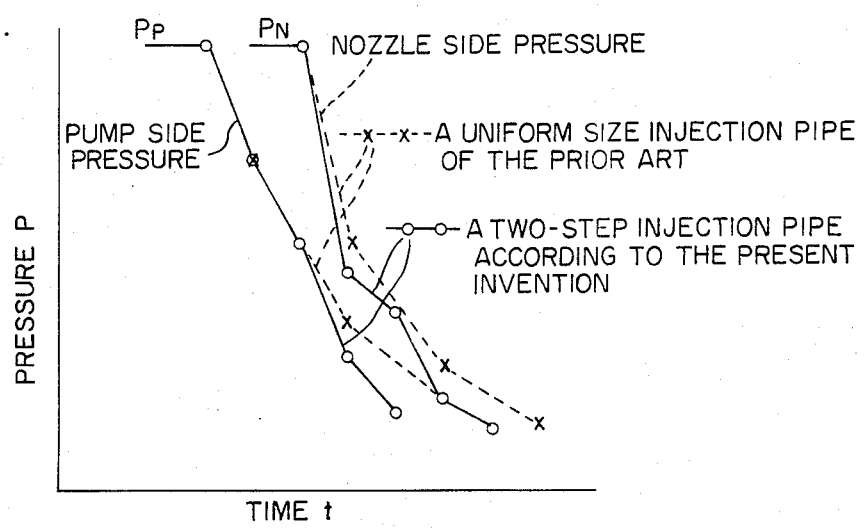

FIG. 5(*a*) shows the pressure rising characteristic in the beginning of injection, in which at first, pressure rise on the pump side is fast in the case of the two-step injection pipe illustrated in FIG. 4 according to the present invention as compared to the injection system in the prior art illustrated in FIG. 2, and as a result of which, the pressure rise on the nozzle side is also fast, as also shown in FIG. 5*a*. Thus, the present invention is effective for raising the injection pressure.

FIG. 5(*b*) shows a pressure falling characteristic at the end of injection for the injection pipe illustrated in FIG. 4, as compared with that of an injection pipe having a uniform cross-sectional area in the prior art. From this figure it can be seen that in the case of the two-step injection pipe according to the present invention, the pressure falls off fast and the cut-off of injection is excellent. As a result, the average fuel injection pressure rises, and obviously the injection period is shortened.

Figure 6:
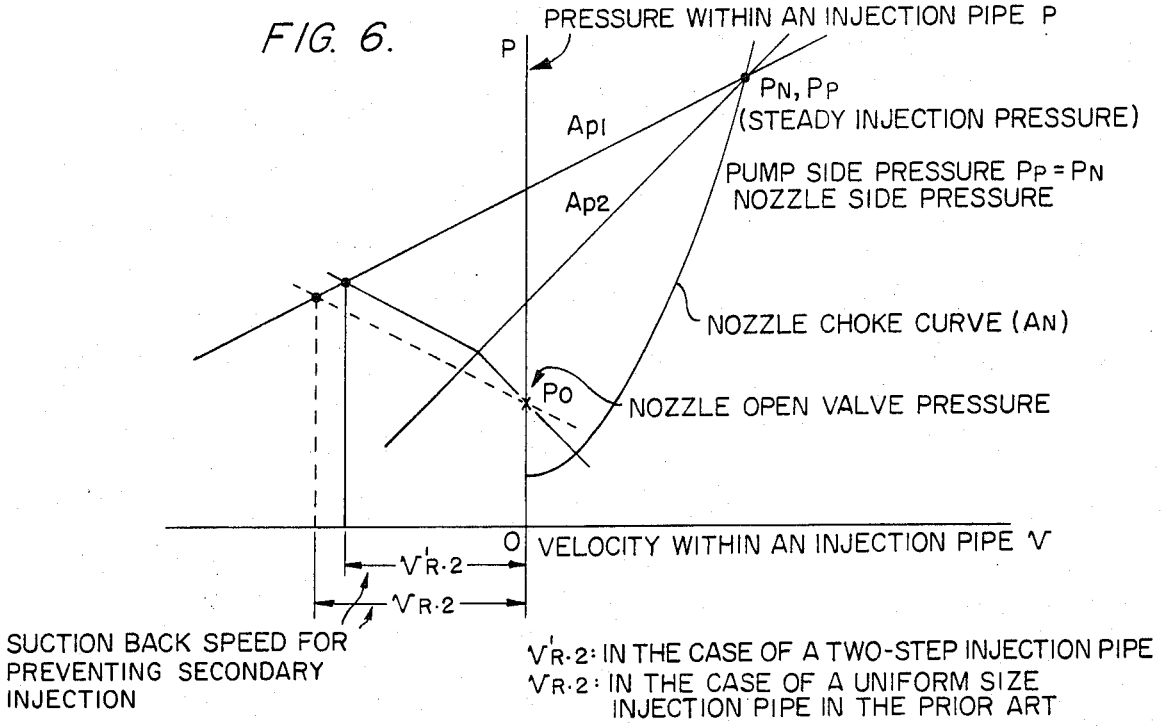
FIG. 6 is a diagram showing a limit suction back speed for preventing secondary injection in the same case.

FIG. 6 shows a generation limit of secondary injection on a P-$\nu$ state diagram obtained by the aforementioned characteristic curve method, in which the magnitude of the limit suction back velocity $\nu_{R2}$ that is necessary for preventing secondary injection is less than the magnitude of the limit suction back velocity $\nu_{R2}$ of an injection pipe having a uniform cross section in the prior art of ($|\nu_{R2}|<|\nu'_{R2}|$). Thus, $\nu_{R2}$ can be made small in the case of the two-step injection pipe according to the present invention, hence, the amount of suction back of the delivery valve is also smaller by the corresponding amount, and therefore, prevention of secondary injection is easy to accomplish.

In the above-described case, the following advantages can be obtained.

While an operation and a characteristic of a fuel injection system has been disclosed above and an effect of an injection characteristic has been described above, in summary, the effect of the present invention exists in (1) rise of an average injection pressure, (2) shortening of an injection period, (3) improvement in the cut-off of injection and (4) prevention of secondary injection. These characteristics are especially remarkable in the case where an injection pipe of a diesel engine is relatively long (in the case where the number of reciprocating propagation of a pressure wave $n=T_F/(L_p/2a)$ is small, where $T_F$ represents an injection period and a represents a velocity of sound in oil), and they result in great improvements in combustion performance of an engine (reduction of exhaust smoke, reduction of particular and lowering of fuel consumption).

Figure 7:
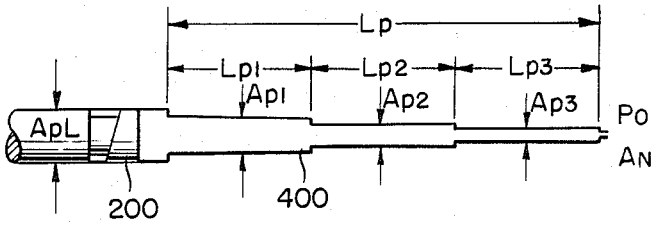
FIG. 7 is a diagrammatic view of a fuel injection system provided with a three-step fuel injection pipe according to a second preferred embodiment of the present invention.

FIG. 7 is a diagrammatic view of a second preferred embodiment of the present invention, in which the case of a three-step injection pipe is illustrated. More particularly, a structure of an injection pipe is divided into three portions, the cross-sectional areas and lengths of the respective portions being represented by $A_{p1}$ and $L_{p1}$, $A_{p2}$ and $L_{p2}$, and $A_{p3}$ and $L_{p3}$, respectively, and the cross sections fulfil the relation of $A_{p1}>A_{p2}>A_{p3}$. It is to be noted that reference character $L_p$ represents the total length of the injection pipe, reference character $A_{pL}$ represents the cross-sectional area of a plunger, reference character $A_N$ represents the cross-sectional area of a nozzle and reference character $P_o$ represents the open valve pressure of the nozzle.

The operation of this preferred embodiment is also similar to that of the first preferred embodiment. However, owing to the fact that reflection points of a pressure wave exist at three locations, a smoother characteristic than the first preferred embodiment can be obtained, but the basic effects of the two embodiments are similar.

Figure 10A:
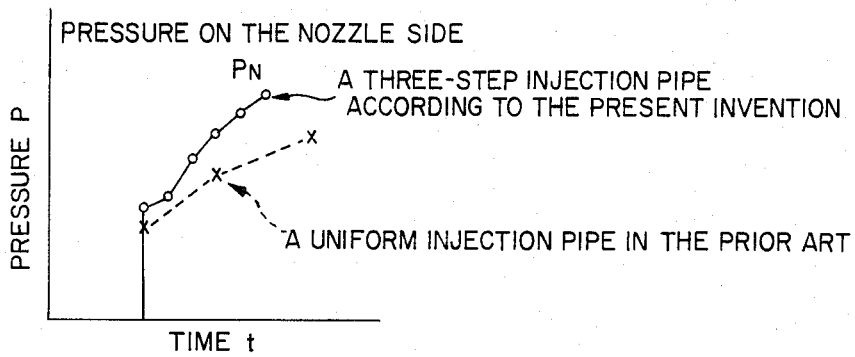
Figure 10B:
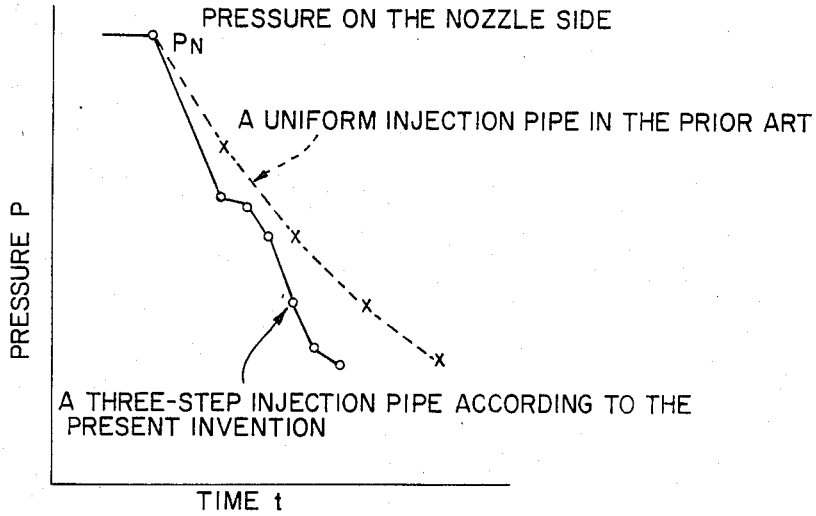

FIG. 10(*a*) shows a pressure rising characteristic for the second embodiment at the beginning of injection in comparison with that of a uniform cross-sectional injection pipe of the prior art, in which like the first preferred embodiment, the pressure rise is faster in the case of the injection pipe according to the present invention.

FIG. 10(*b*) shows a pressure falling characteristic for the second embodiment at the end of injection in comparison with that of a uniform cross section injection pipe in the prior art, in which the pressure fall is faster in the case of the three-step injection pipe according to the present invention (second embodiment) than in the case of the uniform cross section injection pipe in the prior art.

As a result, the injection becomes an injection of high pressure having an excellent cut-off at the end of the injection, and a rise of the average injection pressure and a shortening of the injection period can be realized.

Figure 11:
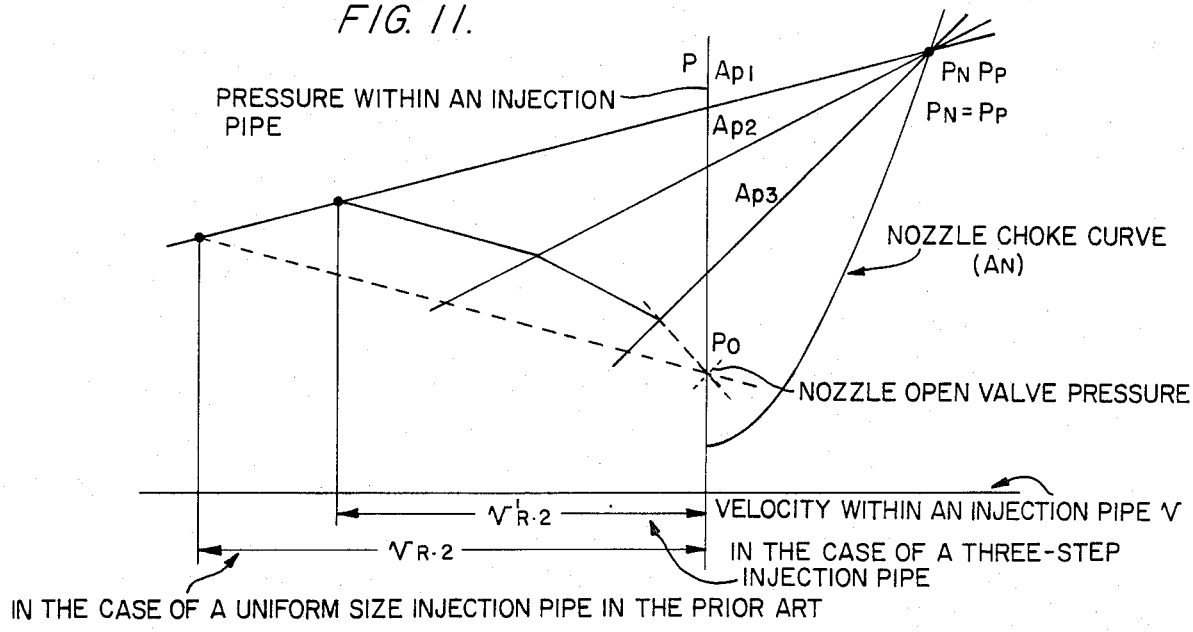
FIG. 11 is a diagram showing a limit suction back speed for preventing secondary injection of the same fuel injection system, FIGS. 12(*a*) and 12(*b*) show a fifth preferred embodiment of the present invention, FIG. 12(*a*) diagrammatically showing the case of a long fuel injection pipe, FIG. 12(*b*) diagrammatically showing the case of a short fuel injection pipe, FIGS. 13(*a*) and 13(*b*) show a sixth preferred embodiment of the present invention, in which a high pressure fuel injection pipe between an inlet and an outlet is diagrammatically shown such that it is narrowed in a stepwise manner rather than continuously as is the case with FIGS. 12(*a*) and 12(*b*), FIGS. 14(*a*) and 14(*b*) show a seventh preferred embodiment of the present invention, in which a shorter injection pipe (total length $L_1$) in FIG. 14(*b*) has the same configuration as the portion having a length $L_1$ as measured from the pump side of a longer injection pipe in FIG. 14(*a*), the pipes being oriented in parallel for convenience of comparison, FIGS. 15(*a*) and 15(*b*) show an eighth preferred embodiment of the present invention, in which a shorter injection pipe (total length $L_2$) in FIG. 15(*b*) has the same configuration as the portion having a length $L_2$ as measured from the nozzle side of a longer injection pipe in FIG. 15(*a*), the pipes being oriented in parallel for convenience of comparison, FIGS. 16(*a*) and 16(*b*) show a ninth preferred embodiment of the present invention, in which a shorter injection pipe (total length $L_3$) in FIG. 16(*b*) has the same configuration as a portion of a longer injection pipe in FIG. 16(*a*), the pipes being oriented in parallel for convenience of comparison.

FIG. 11 shows the result of an investigation of a limit suction back velocity for preventing secondary injection through a similar process to that used in FIG. 6, with respect to a three-step injection pipe. In this figure, the magnitude of the limit suction back velocity $\nu_{R2}$ in the prior art is greater than the magnitude of the limit suction back velocity of $\nu_{R2}$ with the invention, the injection pipe according to the present invention thus fulfilling the relation $|\nu_{R2}|>|\nu'_{R2}|$ and so, secondary injection can be prevented with a slow suction back velocity.

As described above, the second preferred embodiment has a more excellent characteristic than the first preferred embodiment and very effectively improves the performance of an engine.

Figure 8:
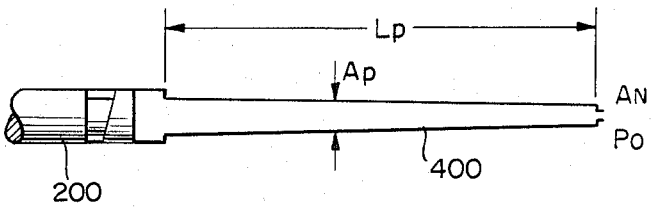
FIG. 8 is a diagrammatic view of a fuel injection system provided with a varying cross section fuel injection pipe according to a third preferred embodiment of the present invention.

FIG. 8 shows a third preferred embodiment according to the present invention, which was further developed from the above-described first and second preferred embodiments in that the cross-sectional area of an injection pipe is continuously and successively reduced from the pump side towards the nozzle side. This embodiment can provide a similar effect as the first and second preferred embodiment, and also since reflection points of a pressure wave are distributed and provide smooth pressure change, a further desirable injection characteristics is provided.

Figure 9:
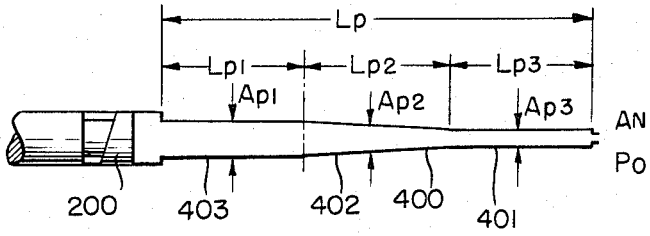
FIG. 9 is a diagrammatic view of a fuel injection system provided with another varying cross section fuel injection pipe according to a fourth preferred embodiment of the present invention, FIG. 10(*a*) is a diagram showing a pressure rising characteristic in the beginning of injection of the fuel injection system provided with the three-step fuel injection pipe shown in FIG. 7, FIG. 10(*b*) is a diagram showing a pressure falling characteristic at the end of injection of the same fuel injection system.

FIG. 9 shows a fourth preferred embodiment of the present invention, which is constructed of uniform cross-sectional area portions 401 and 403 and a varying cross-sectional area portion 402. In this embodiment the above effects and advantages are similar to those of the above-described preferred embodiments. In this case also, appropriate lengths $L_{p1}$, $L_{p2}$ and $L_{p3}$ and appropriate cross-sectional areas $A_{p1}$, $A_{p2}$ and $A_{p3}$ of the respective portions are selected depending upon a rotational speed of an engine, the length of the injection pipe and the fuel injecton rate.

While four preferred embodiments of the present invention have been described above, the essence of the present invention resides in that a fuel injection pipe or a fuel oil path corresponding thereto has its cross-sectional area reduced either continuously or in a stepwise manner from the pump side towards the nozzle side and the relation between the magnitude of the cross-sectional area variation and its position can be appropriately determined depending upon a rotational speed of an engine, the length of the fuel injection pipe, etc.

Figure 12:
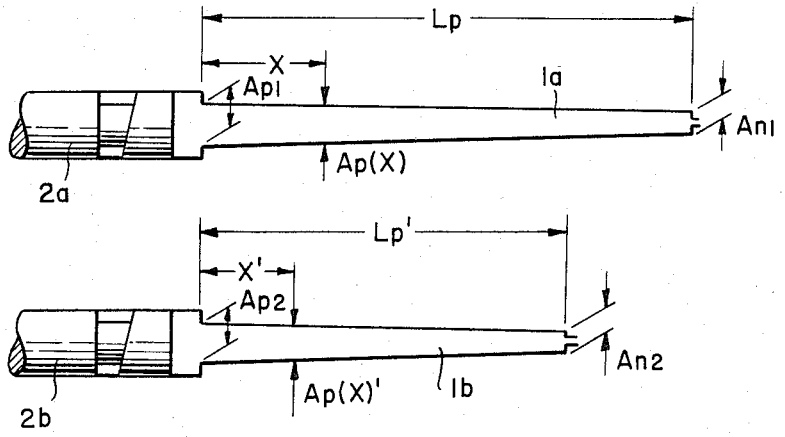

FIG. 12 shows a fifth preferred embodiment of the present invention. In FIG. 12(*a*), reference numeral 1*a* designates a long injection pipe having a length $L_p$, and numeral 2*a* designates a plunger. In FIG. 12(*b*), reference numeral 1*b* designates a short injection pipe having a length $L'_p$, and numeral 2*b* designates a plunger. The cross-sectional areas $A_{p1}$ and $A_{p2}$, respectively, at the ends on the pump side and the cross-sectional areas $A_{n1}$ and $A_{n2}$, respectively, at the ends of the nozzle side of these two injection pipes are respectively nearly (approximately) equal to each other ($A_{p1}=A_{p2}$, $A_{n1}=A_{n2}$). In addition, at the midway portion of the injection pipe also, representing the cross-sectional areas of the pipes at the points remote from the pump side by distances x and x', respectively, by A(x) and A(x'), then at two points fulfilling the relation $(x/L)=(x'/L')$, $A_p(x)\approx A(x')$, is established. In other words, the cross-sectional areas of the respective injection pipes at the points where the proportions of the distances from the pump side to the respective total pipe lengths are the same, are chosen nearly (approximately) equal to each other.

Now the operation of the above-described embodiment will be explained.

In a fuel injection device having an injection pipe whose cross-sectional area is continuously reduced from the pump side to the nozzle side, enhancement of the average injection pressure, shortening of the injection period, improvements in cut-off of injection and prevention of secondary injection can be expected. As a result, the fuel injection device provides significant improvements in the combustion performance of an engine (reduction of exhaust smoke, reduction of particulate and lowering of fuel consumption).

In the structures shown in FIG. 12, even if the lengths of the injection pipes are different, since the cross-sectional areas of the injection pipes in the vicinities of the pump ends are nearly equal to each other, the pressures on the pump side become nearly equal, and the cross-sectional areas on the nozzle side of both injection pipes are nearly equal to each other, moreover the ratios of the nozzle cross-sectional area to the injection pipe cross-sectional area, that is, the nozzle choke ratios, are nearly equal to each other between them, and therefore, the generation characteristics of secondary injection become nearly equal to each other.

Figure 13:
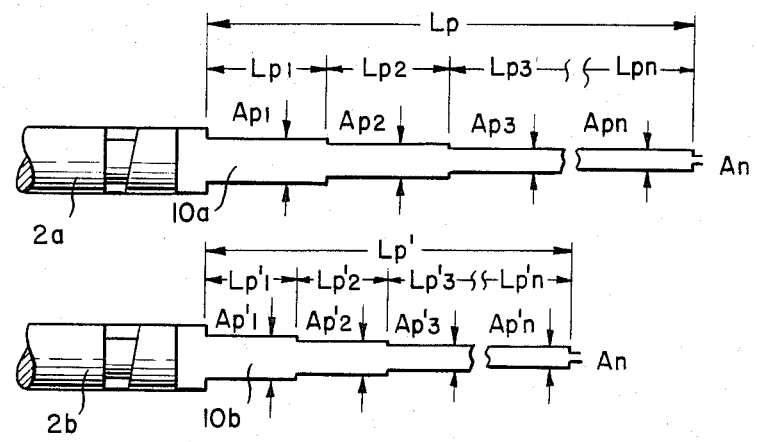

FIG. 13 shows a sixth preferred embodiment of the present invention in which the cross-sectional area of a fuel injection pipe is varied in a stepwise manner. The essence of this embodiment is exactly the same as the fifth preferred embodiment. The total length of a long injection pipe 10*a* is $L_p$, the length of the portion having a cross-section area $A_{p1}$ as measured from the pump side is $L_{p1}$, and the lengths of the successive portions having cross-sectional areas $A_{p2}, \ldots, A_{pn}$ are $L_{p2}, \ldots, L_{pn}$, respectively. A total length of a short injection pipe 10*b* is $L'_p$, the length of the portion having a cross-sectional area $A'_{p1}$ as measured from the pump side is $L'_{p1}$, and the lengths of the successive portions having cross-sectional areas $A'_{p2}, \ldots, A'_{pn}$ are $L'_{p2}, \ldots, L'_{pn}$, respectively. Then, at the positions of $(L_{p1}/L_p)=(L'_{p1}/L'_p)$, $(L_{p2}/L_p)=(L'_{p2}/L'_p), \ldots, (L_{pn}/L_p)=(L'_{pn}/L'_p)$, the relations of $A_{p1}=A'_{p1}$, $A_{p2}=A'_{p2}, \ldots, A_{pn}=A'_{pn}$ are fulfilled, and the effects and advantage of this preferred embodiment are the same as those of the fifth preferred embodiment.

In the above-described fifth and sixth preferred embodiments, reference numerals 2*a* and 2*b* designate plungers of the fuel injection pumps in the cases of the long injection pipe and the short injection pipe.

According to the above-described fifth and sixth preferred embodiment, in a fuel injection device having fuel injection pipes of different lengths, since the cross-sectional areas at the inlet and at the outlet, respectively, of the fuel injection pipes leading to the respective cylinders are made nearly equal to each other, and further since the cross-sectional areas between the inlet and the outlet is reduced continuously or in a stepwise manner so that the cross-sectional areas at the positions where the proportion of the distance from an end portion to the entire length is equal to each other may be made nearly equal, cut-off of fuel injection is improved, the performance of the internal combustion engine is enhanced, and there is provided a fuel injection device having excellent durability.

Generally, in a multi-cylinder engine, in some cases fuel injection pipes leading to the cylinders and having different length are used due to the arrangement of the fuel injection pump. In such a fuel injection system, three different preferred embodiments will be explained in the following, in which the cross-sectional area of the fuel injection pipe is continuously reduced from the side of the fuel injection pump towards the side of the nozzle of the fuel injection valve.

Figure 14:
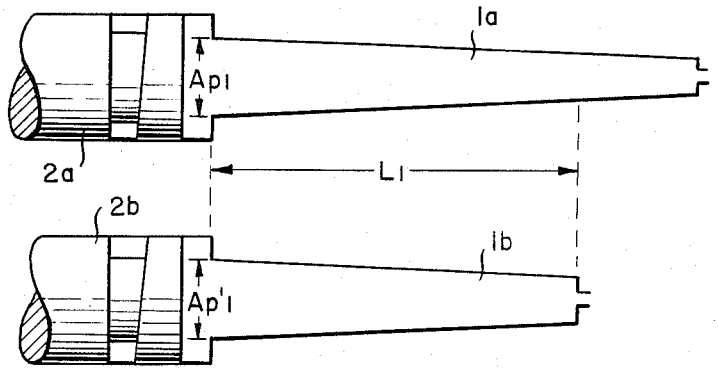

FIGS. 14(*a*) and 14(*b*) show a seventh preferred embodiment of the present invention, in which the cross-sectional areas of oil paths on the side of the pump plungers 2*a* and 2*b* of a long injection pipe 1*a* shown in FIG. 14(*a*) and a short injection pipe 1*b* shown in FIG. 14(*b*) are equal to each other ($A_{p1}=A'_{p1}$), and the short injection pipe (total length $L_1$) has the same configuration as the portion $L_1$ on the pump side of the long injection pipe.

Now the operation of the above-described seventh preferred embodiment will be explained.

In a fuel injection device in which a cross-sectional area of a fuel injection pipe is continuously reduced from the pump side towards the nozzle side, enhancement of the average injection pressure, shortening of the injection period, improvements in cut-off of injection, and prevention of secondary injection can be expected, and therefore, the fuel injection device greatly improves the performance of an engine (reduction of exhaust, reduction of particulate and lowering of fuel consumtion). As described above, according to the above-described embodiment, since the short injection pipe has the same configuration as one portion of the long injection pipe, both injection pipes can be produced with the same production equipment, and so, lowering of the production cost becomes possible. Furthermore, since the cross-sectional areas of the injection pipes on the pump side are the same, the loads for the respective cylinders are nearly constant in view of a pressure-resistivity of the pump, and so, the fuel injection device is advantageous also in regard to mechanical strength.

From the above-mentioned reasons, development of an engine that is of low cost, highly reliable and excellent in a combustion performance, becomes possible.

Figure 15:
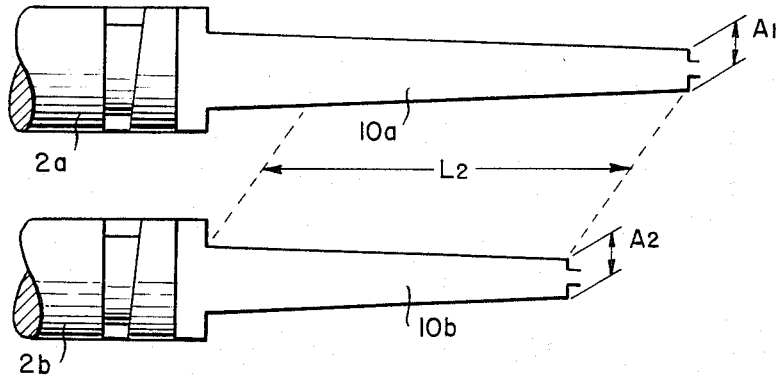

FIGS. 15(*a*) and 15(*b*) show an eighth preferred embodiment of the present invention. In this preferred embodiment, the cross-sectional of the oil path on the nozzle side of a long injection pipe 10*a* and a short injection pipe 10*b* are equal to each other ($A_1=A_2$), and moreover, the short injection pipe (total length $L_2$) has the same configuration as the portion having a length $L_2$ as measured from the nozzle side of the long injection pipe. This preferred embodiment is similar to the seventh preferred embodiment in that the cross-sectional area of the injection pipe is varied along the length of the pipe and the short injection pipe has the same configuration as one portion of the long injection pipe. In this eighth preferred embodiment, the cross-sectional areas of the injection pipes on the nozzle side becomes equal to each other for every cylinder. Accordingly, the injection hole choke ratio also can be equalized for every cylinder, so that the condition for generating secondary injection becomes nearly the same with respect to every cylinder. Thus, the countermeasure for secondary injection become easy, and this is advantageous for the countermeasure for the exhaust gas problem.

Figure 16:
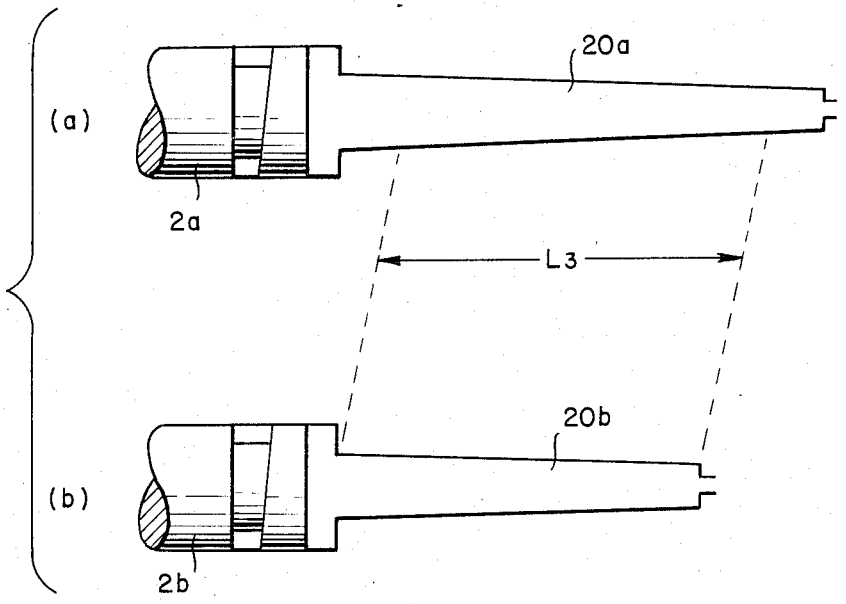

FIG. 16 shows a ninth preferred embodiment of the present invention, and it is assumed that the presumption condition therefor is the same as that of the seventh preferred embodiment shown in FIG. 14. In FIG. 16, a short injection pipe 20*b* has the same configuration as one portion (having a length $L_3$) in the mid-portion of the long injection pipe 20*a*, and this embodiment achieves the same effects and advantages as the above-described seventh and eighth preferred embodiments.

According to the aforementioned seventh, eighth and ninth preferred embodiments, in a fuel injection device having fuel injection pipes of different pipe lengths and having the cross-sectional areas of the oil paths reduced from the injection pump side towards the injection nozzle side, since with respect to the injection pipes to be mounted to two or more cylinders, a short injection pipe is formed in the same shape as a section or segment of a long injection pipe, a fuel injection device in which the pressure on the fuel injecion pump side is lowered while the pressure on the fuel injection nozzle side is raised, high pressure fuel can be injected and cut-off of injection is improved, which can enhance the performance of an internal combustion engine, and which has good durability, can be provided at a low cost.

Figure 17:
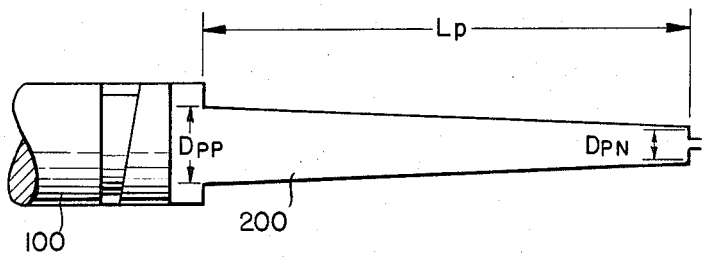
FIG. 17 is a diagrammatic view of a fuel injection device according to a tenth preferred embodiment of the present invention.

FIG. 17 is a diagrammatic view showing a tenth preferred embodiment of the present invention.

In this figure reference numeral 100 designates a plunger, and numeral 200 designates a fuel injection pipe. The basic construction of the fuel injection device is similar to that of the fuel injection device in the prior art. Representing the length of the portion corresponding to the fuel injection pipe 200 by $L_p$, the pipe inner diameter on the injection pump side (on the side of the plunger 100) by $D_{pp}$ and the pipe inner diameter on the injection nozzle side by $D_{PN}$, then the inner diameter of the pipe in the midway is formed to be reduced linearly along the length from $D_{PP}$ to $D_{PN}$.

Figure 18:
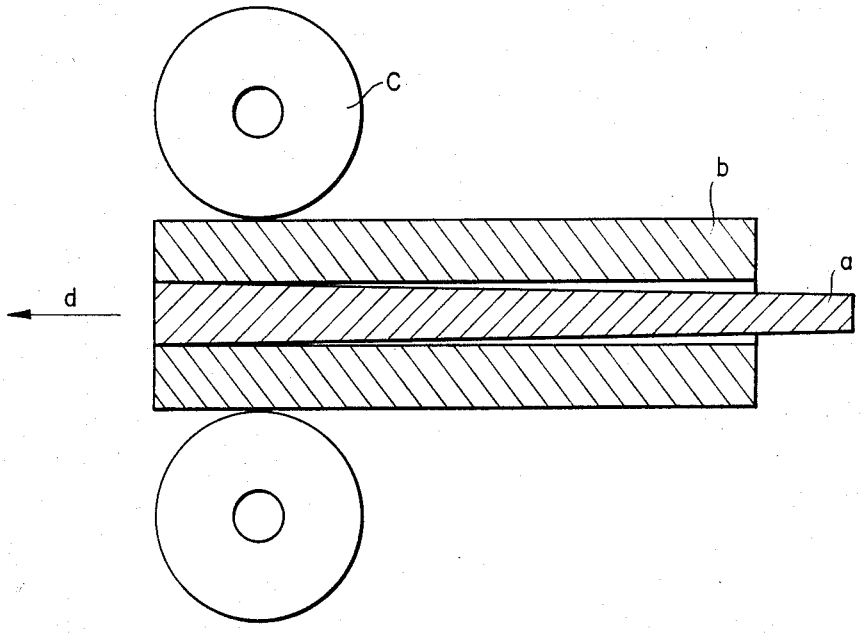
FIG. 18 is a schematic view showing a process for working the fuel injection pipe shown in FIG. 17.

The injection pipe 200 having the structure shown in FIG. 17 has the merit that since the inner diameter varies linearly, manufacture of the pipe is easy. More particularly, as a method for working a tapered circular pipe, for instance, as shown in FIG. 18 the method has been known in which a tapered core metal a is inserted into a conventional circular pipe b and by movement (forced displacement) of rollers c a center hole having a varying cross-sectional area is shaped. In the case of the injection pipe 200 according to the present invention, since this core metal a is necessitated only to be finished to have a uniform taper, the shaping of the injection pipe 200 can be performed very easily. It is to be noted that reference character d indicates a direction of drawing.

Figure 19:
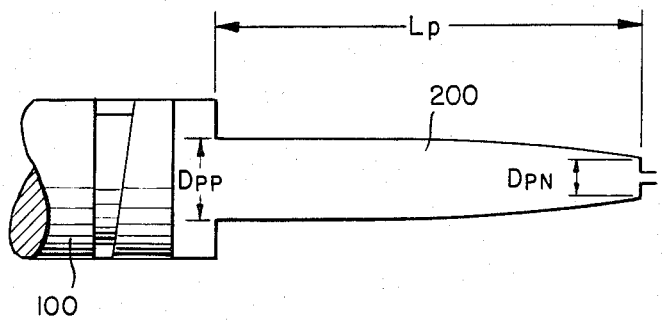
FIG. 19 is a diagrammatic view of a fuel injection device according to an eleventh preferred embodiment of the present invention.

FIG. 19 is a diagrammatic view showing an eleventh preferred embodiment of the present invention.

In this figure, reference numeral 100 designates a plunger of a fuel injection pump and numeral 200 designates a fuel injection pipe. Representing the length of the portion corresponding to the fuel injection pipe 200 by $L_p$, the inner diameter of the injection pipe on the side of the injection pump (on the side of the plunger 100) by $D_{PP}$ and that on the side of the fuel injection nozzle by $D_{PN}$, then in this preferred embodiment the fuel injection pipe is constructed in such manner that the inner diameter of the pipe may be reduced parabolically from $D_{PP}$ to $D_{PN}$.

Figure 20:
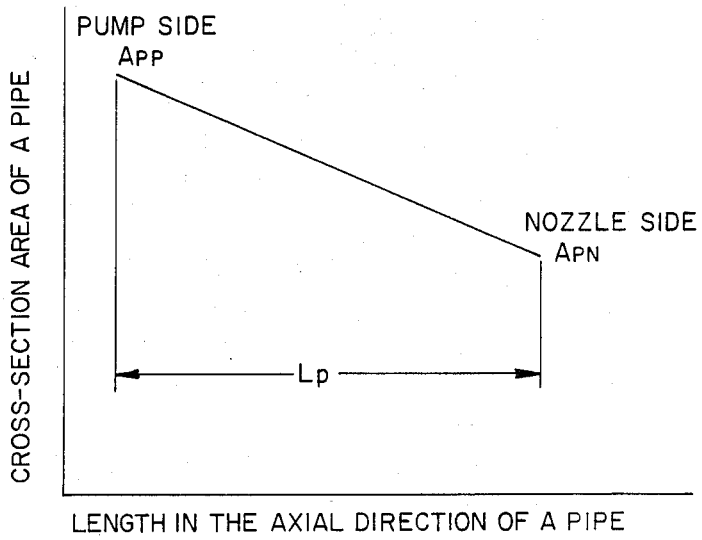
FIG. 20 is a diagram showing a variation of a cross-sectional area of a pipe.
Figure 21:
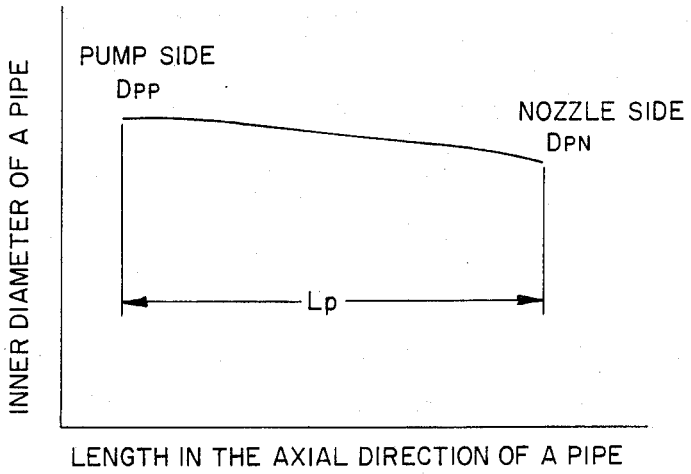
FIG. 21 is a diagram showing a variation of an inner diameter of a pipe, FIG. 22(*a*) is a diagram showing a relation between a pressure within an injection pipe and a flow velocity within the injection pipe, FIG. 22(*b*) is a diagram showing a delivery period and an injection period.

In other words, as shown in FIGS. 20 and 21 which respectively illustrate variations of the cross-sectional area of a pipe and the inner diameter of the pipe as a function of the pipe length, the cross-sectional area of the pipe is reduced linearly in the lengthwise direction of the pipe and the inner diameter of the pipe is reduced parabolically.

Figure 22A:
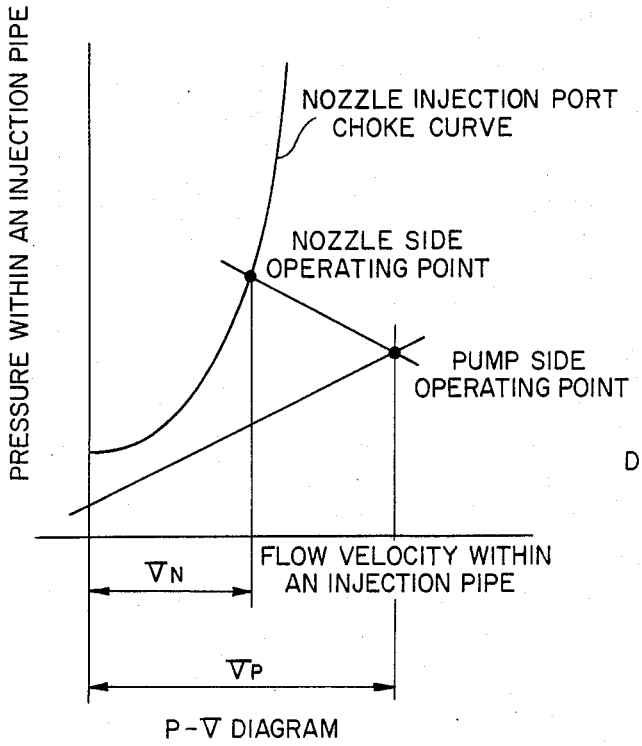
Figure 22B:
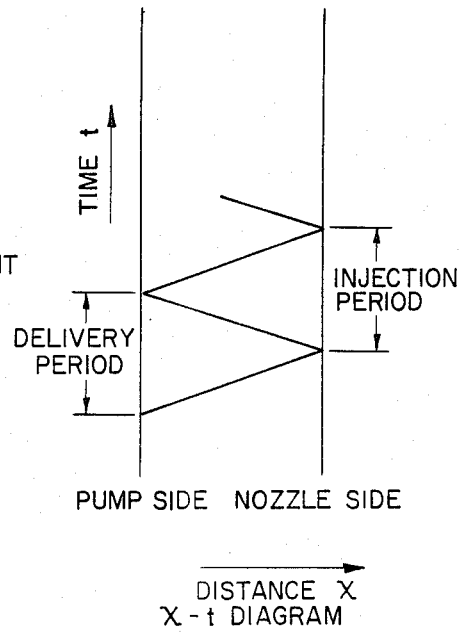

In the fuel injection pipe 200 having the structure shown in FIG. 19, the pipe cross-sectional area is varied so that the flow velocity within the pipe may become uniform along the direction of the pipe length. That is, considering the flow according to the well-known characteristic curve method which is a one-dimensional pipe unsteady flow analytic method, it becomes as shown in FIGS. 22*a* and 22*b*. Representing flow velocities on the pump side and on the nozzle side in a pipe having a uniform inner diameter in the prior art by $V_P$ and $V_N$, respectively, the cross-sectional area of the said pipe by $A_{PO}$, the flow velocity and the cross-sectional area on the pump side of the injection pipe 200 according to the present invention by $V'_p$ and $A_{pp}$, respectively, and those on the nozzle side by $V'_N$ and $A_{PN}$, respectively, then the following relation is established:

$$V'_p = \frac{A_{po}}{A_{pp}} \cdot V_p,\ V'_N = \frac{A_{po}}{A_{PN}} \cdot V_N$$

Thus, $A_{pp}$ and $A_{PN}$ must be close to realize the relation of $V'_p = V'_N = V_o$ (uniform flow velocity).

Assuming $(A_{pp}/A_{PN}) = (V_p/V_N) = C$, then since the pipe cross-sectional area varies linearly, a cross-sectional area $A_p$ and a time-averaged flow velocity V at a midpoint apart from the pump side by a length L are calculated as follows:

$$A_p = A_{pp} - (A_{pp} - A_N)\frac{L}{L_p} = A_{PN}\left\{ C - (C-1)\frac{L}{L_p} \right\}$$

$$V = \frac{A_{po}}{A_p}\left\{ V_p - (V_p - V_N)\frac{L}{L_p} \right\} = \frac{A_{po}}{A_p} V_N \left\{ C - (C-1)\frac{L}{L_p} \right\}$$

Accordingly, V is represented as follows:

$$V = \frac{A_{po}}{A_p} \cdot V_N \cdot \frac{A_p}{A_{PN}} = \frac{A_{po}}{A_{PN}} \cdot V_N = V_N' = V_o \text{ (uniform flow velocity)}$$

Figure 23:
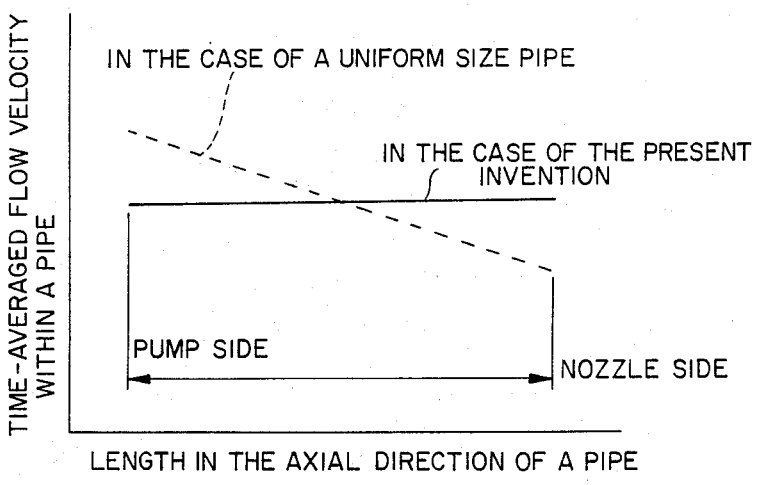
FIG. 23 is a diagram showing a variation of a time-averaged flow velocity within a pipe.

That is, the pipe cross-sectional area is reduced linearly in the direction of the pipe length so that a time-averaged flow velocity distribution may become linear as shown in FIG. 23.

Consequently, since the pressure loss within the injection pipe is reduced, it become possible to lower the pressure on the pump side, and therefore, there is an advantage that the present invention provides increased durability of the fuel injection pump and the fuel cam.

What is claimed is:

1. A fuel injection device, comprising:

a fuel pump;

a fuel injection nozzle; and a longitudinally extending fuel injection pipe, circular in cross section all along the length thereof, having opposite first and second ends, respectively connected at said first and second ends to said fuel injection pump and said fuel injection nozzle;

said fuel injection pipe consisting of first, second and third longitudinally extending pipe sections connected end-to-end, said first pipe section connected to said fuel pump and having an inner diameter which is constant all along its length, said third pipe section being connected to said nozzle and having an inner diameter which is constant all along its length, said second pipe section having opposite third and fourth ends and being respectively connected at said third and fourth ends to adjacent ends of said first and third pipe sections;

said second pipe section having an inner diameter which continuously decreases all along its length from said third end to said fourth end.

2. A fuel injection device, comprising:

a fuel injection pump;

a fuel injection nozzle; and a fuel injection pipe, having opposite first and second ends, respectively connected at said first and second ends to said fuel injection pump and said fuel injection nozzle;

said first injection pipe having an inner cross-sectional area which continuously decreases linearly along its length from said first end to said second end.

3. A fuel injection device, comprising:

a fuel injection pump;

a plurality of fuel injection nozzles; and a plurality of fuel injection pipes of different lengths Lp, circular in internal cross section, each having respective first and second ends and connected at said first and second ends to said fuel injection pump and a corresponding one of said plurality of fuel injection nozzles, respectively, wherein the inner diameter of each of said plurality of fuel injection pipes is smaller at said second end than at said first end, the internal cross-sectional area $A_p$ of each of said plurality of fuel injection pipes varying along its length such that all distances x, $0 \leqq x \leqq L_p$, from said first end along said length, for any given ratio $x/L_p$, the area $A_p$ is approximately the same for every one of said plurality of fuel injection pipes.

4. A fuel injection device as in claim 3, wherein the inner diameter of every one of said plurality of fuel injection pipes decreases continuously from said first end to said second end.

5. A fuel injection device as in claim 3, wherein the inner diameter of every one of said plurality of fuel injection pipes decreases stepwise from said first end to said second end.

6. A fuel injection device, comprising:

a fuel injection pump;

a plurality of fuel injection nozzles; and a plurality of fuel injection pipes of differing lengths $L_p$, circular in internal cross section, each having respective first and second ends, being connected at said first and second ends to said fuel injection pump and a corresponding one of said plurality of fuel injection nozzles, respectively, and having an inner diameter which decreases from said first end to said second end;

the inner diameter of every one of said plurality of fuel injection pipes other than the largest one thereof being substantially identical all along the length thereof to the inner diameter at corresponding positions along a corresponding continuous segment of said longest one of said plurality of fuel injection pipes.

* * * * *